US006210296B1

(12) United States Patent
Gabriel

(10) Patent No.: US 6,210,296 B1
(45) Date of Patent: Apr. 3, 2001

(54) PORTABLE TENNIS SCOREKEEPER DEVICE

(76) Inventor: Wendell J. Gabriel, 530 NE. 119th St., Biscayne Park, FL (US) 33161

( * ) Notice: Subject to any disclaimer, the term of this patent is extended or adjusted under 35 U.S.C. 154(b) by 0 days.

(21) Appl. No.: 09/366,829

(22) Filed: Aug. 4, 1999

(51) Int. Cl.[7] ..... A63B 69/00

(52) U.S. Cl. ..... 473/464; 473/553; 116/225; 700/92

(58) Field of Search ..... 473/464, 459, 473/422, 415, 553; 116/222, 223, 224, 225; 700/92

(56) References Cited

U.S. PATENT DOCUMENTS

| | | | | |
|---|---|---|---|---|
| 3,730,131 | * | 5/1973 | Izzo . | |
| 3,777,699 | * | 12/1973 | Pfleger . | |
| 3,936,963 | * | 2/1976 | Chan . | |
| 4,132,187 | * | 1/1979 | Moebius . | |
| 4,158,342 | * | 6/1979 | Scruggs . | |
| 4,189,143 | | 2/1980 | Van Auken et al. | 273/78 R |
| 4,212,261 | * | 7/1980 | Gaetano . | |
| 4,331,098 | | 5/1982 | Rubano | 116/225 |
| 4,357,895 | | 11/1982 | Nightingale | 116/225 |
| 4,498,668 | | 2/1985 | Bowen | 273/73 R |
| 4,557,215 | | 12/1985 | Petersson | 116/222 |
| 4,712,504 | | 12/1987 | Zarley et al. | 116/222 |
| 4,738,449 | | 4/1988 | Droz | 273/29 R |
| 5,048,452 | | 9/1991 | Haddock et al. | 116/225 |
| 5,062,381 | | 11/1991 | Hendricks | 116/225 |
| 5,489,122 | | 2/1996 | Pittner | 283/49 |

* cited by examiner

*Primary Examiner*—Michael O'Neill
(74) *Attorney, Agent, or Firm*—Flanagan & Flanagan; John R. Flanagan; John K. Flanagan

(57) ABSTRACT

A portable tennis scorekeeper device includes a portable body attachable to an article of apparel or insertable within a pocket of an article of apparel worn by a tennis player and a scoreboard applied to a side of the portable body. The scoreboard includes a middle region and a pair of opposite side regions. The middle region includes a first portion having a plurality of numbers and letters associated with points scored in a game of a tennis match, a pair of tracks extending along opposite sides of the first portion, second and third portions each disposed on a side of one of the tracks opposite from the first portion and having a plurality of numbers associated with points scored in a tiebreaker of the tennis match, and a pair of markers each mounted to and for undergoing movement along one of the tracks and alignable with the numbers and letters of the first, second and third portions. The side regions of the scoreboard are each disposed on a side of one of the second and third portions opposite from the tracks. Each side region has a grid formed by a side axis, an end axis extending generally orthogonal to the side axis, a plurality of boxes arranged in rows and columns and aligned with one another adjacent to the side and end axes, a plurality of numbers associated with games won in one or more sets of the tennis match disposed numerically along the side axis and a plurality of numbers associated with sets of the tennis match disposed numerically along the end axis, and a plurality of markers each mounted to and being movable along the grid in generally orthogonal directions and positionable on one of the boxes of the grid and alignable with the numbers along each of the side and end axes of the grid.

19 Claims, 2 Drawing Sheets

PORTABLE TENNIS SCOREKEEPER DEVICE

BACKGROUND OF THE INVENTION

1. Field of the Invention

The present invention generally relates to devices for keeping a score and, more particularly, is concerned with a portable tennis scorekeeper device.

2. Description of the Prior Art

A score is kept in most sports and games. A large display and a referee are often employed to keep score in an organized tennis match. Large displays and referees, however, are generally not available for informal tennis matches. Players of an informal tennis match often must keep track of the score themselves. Though seemingly a simple task, keeping score can be a distraction for the players. Disagreements regarding the score may arise between the players when the memory of one or more of the players is relied upon to keep the score. A variety of devices have been developed over the years for making the process of scorekeeping less of a burden on the players of an informal tennis match and other sports and games.

Representative examples of prior art scorekeeping devices for various sports and games are disclosed in U.S. Pat. No. 4,189,143 to Van Auken et al., U.S. Pat. No. 4,331,098 to Rubano, U.S. Pat. No. 4,357,895 to Nightingale, U.S. Pat. No. 4,498,668 to Bowen, U.S. Pat. No. 4,557,215 to Petersson, U.S. Pat. No. 4,712,504 to Zarley et al., U.S. Pat. No. 4,738,449 to Droz, U.S. Pat. No. 5,048,452 to Haddock et al., U.S. Pat. No. 5,062,381 to Hendricks and U.S. Pat. No. 5,489,122 to Pittner. While these prior art scorekeeping devices appear to be satisfactory in use for the specific purposes for which they were designed, none of them seem to provide tennis players with an ideal solution for keeping score during informal matches.

Consequently, a need still exists for a scorekeeping device which provides players of informal tennis matches with a more effective means for keeping score without introducing any new problems in place of the problem of the prior art.

SUMMARY OF THE INVENTION

The present invention provides a portable tennis scorekeeper device designed to satisfy the aforementioned need. The portable tennis scorekeeper device of the present invention allows players of an informal tennis match to keep score on a scoreboard which is applied on an article of apparel worn by a player or placed within a pocket of an article of apparel worn by a player. In one embodiment, the portable tennis scorekeeper device enables players to keep track of the points won by each player in singles play or by each team in doubles play. In another embodiment, the portable tennis scorekeeper in addition enables players to keep track of the games and sets won by each player in singles play or by each team in doubles play. The portable tennis scorekeeper device is securable to a belt, a waistband or any other suitable article of clothing worn by a player.

Accordingly, the present invention is directed to a portable tennis scorekeeper device which comprises: (a) a portable body supportable on a tennis player and having a side; and (b) a scoreboard applied to the side of the portable body and including (i) a first portion having a plurality of numbers and letters associated with points scored in a game of a tennis match, (ii) a pair of tracks disposed on opposite sides of and in substantially parallel relation to the first portion, (iii) second and third portions each disposed on a side of one of the tracks opposite from the first portion and disposed in substantially parallel relation to the one track and having a plurality of numbers associated with points scored in a tiebreaker of the tennis match, and (iv) a pair of markers each capable of mounting to and being moved along one of a respective one of the tracks and being alignable with the numbers and letters of the first portion and the numbers of a corresponding one of the second and third portions such that the markers indicate the points scored in a game and in a tiebreaker of the tennis match by players in a singles tennis match or by teams in a doubles tennis match.

More particularly, each of the first, second and third portions and the tracks of the scoreboard are disposed in a substantially diagonal orientation across the side of the portable body. Each track of the scoreboard is comprised of a first fastening means. Each marker of the scoreboard has a bottom surface comprised of a second fastening means complementary to and removably mateable with the first fastening means of a respective one of the tracks of the scoreboard such that each of the markers may be detachably fastened to the respective one of the tracks in alignment with and be movable along and between the numbers and letters of the first portion and the corresponding one of the second and third portions of the scoreboard. The portable body can be a band disposable around a wrist of a tennis player and comprised of a substantially stretchable and resilient material.

The present invention is also directed to a portable tennis scorekeeper device which comprises: (a) a portable body supportable on a tennis player and having a side; and (b) a scoreboard applied to the side of the portable body and having a middle region and a pair of opposite side regions disposed on opposite sides of the middle region; (c) the middle region of the scoreboard including means for indicating the points scored in a game and in a tiebreaker of the tennis match by players in a singles tennis match or by teams in a doubles tennis match; (d) each of the side regions of the scoreboard including (i) a grid having a side axis, an end axis extending in a generally orthogonal relationship to the side axis, a plurality of boxes arranged in rows and columns and aligned with one another adjacent to the side and end axes, a plurality of numbers associated with games won in one or more sets of the tennis match disposed numerically along one of the side and end axes and a plurality of numbers associated with sets of the tennis match disposed numerically along the other of the side and end axes, and (ii) a plurality of markers each capable of mounting to and being moved along the grid and in generally orthogonal directions and positionable on one of the boxes of the grid for alignment with the numbers along the one of the side and end axes of the grid for indicating the games won in a set of the tennis match by players in a singles tennis match or by teams in a doubles tennis match and for alignment with the numbers along the other of said side and end axes of the grid for indicating the set of the tennis match.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
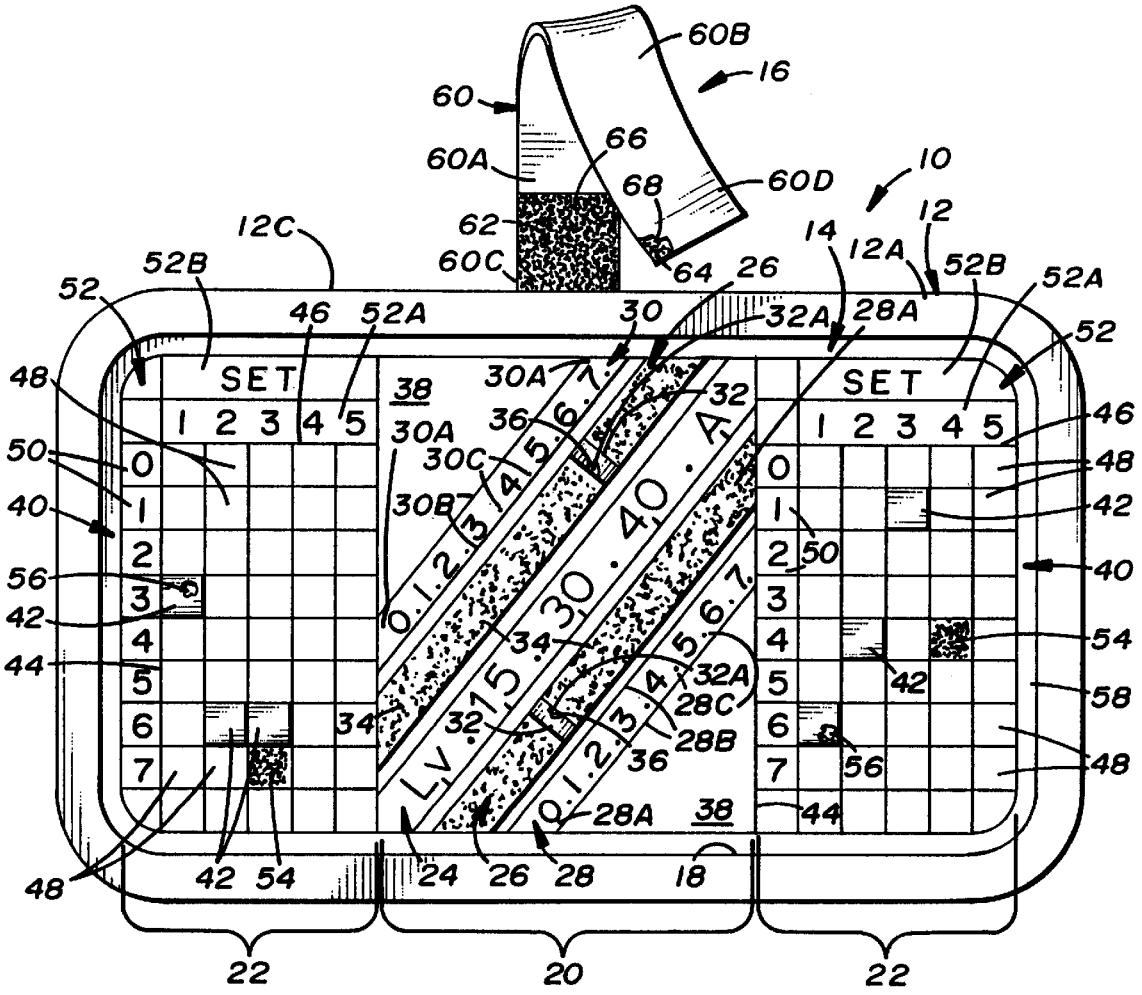
FIG. 1. is a side elevational view of a first embodiment of a portable tennis scorekeeper device of the present invention.

Referring to the drawings and particularly to FIG. 1, there is illustrated a first embodiment of a portable tennis scorekeeper device, generally designated 10, of the present invention. In the first embodiment, the portable tennis scorekeeper device 10 basically includes a portable body 12 and a scoreboard 14 applied to the portable body 12. The portable body 12 can take various forms, all of which are supportable on a tennis player. Some examples are a wrist band, an article of apparel like a T-shirt, a patch attached to an article of apparel and plate having a loop for attachment to an article of apparel. The scorekeeper device 10 also can include means 16, such as a strap, for securing the portable body 12 to the article of apparel, such as a belt or belt loop (not shown), worn by the tennis player.

Figure 2:
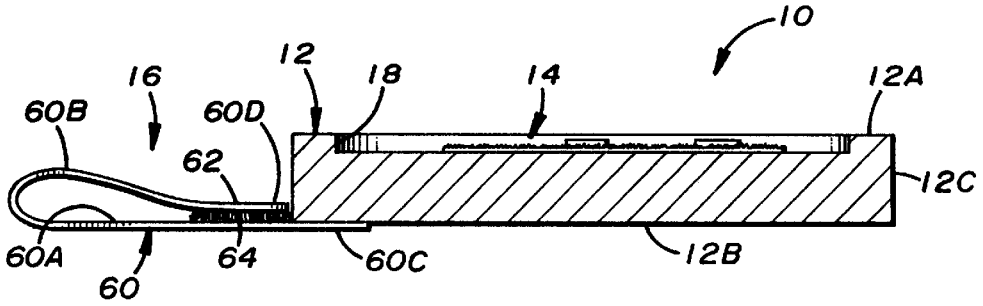
FIG. 2 is a substantially transverse sectional view of the portable tennis scorekeeper device taken along line 2—2 of FIG. 1.

Referring now to FIGS. 1 and 2, as an example, the portable body 12 is comprised of a substantially rigid material, such as plastic. The portable body 12 can have a substantially rectangular configuration with rounded corners, although other shapes are possible. As an example, the portable body 12 has a length which is greater than a width thereof which, in turn, is greater than a thickness thereof. Each of the width and the thickness of the portable body 12 is substantially uniform along the length thereof. The portable body 12 has opposite front and rear sides 12A, 12B and a continuous peripheral edge 12C. The edge 12C interconnects the front and rear sides 12A, 12B. The front side 12A of the portable body 12 has the scoreboard 14 applied thereto. The opposite rear side 12B of the portable body 12 is disposed against the article of apparel worn by the tennis player when the portable body 12 is secured thereto. The portable body 12 also may have a recess 18 in the front side 12A. The recess 18 has a substantially rectangular configuration with rounded corners similar to the configuration of the portable body 12. The recess 18 may be disposed centrally on the front side 12A. As an example, the recess 18 has a length which is greater than a width thereof which, in turn, is greater than a depth thereof. The width and the depth of the recess 18 is substantially uniform along the length thereof. The length and width of the recess 18 are less than the corresponding length and width of the portable body 12. The depth of the recess 18 is less than the thickness of the portable body 12. The portable body 12 has a relatively small size which allows it, as an example, to be held by a hand of the tennis player and retained within the pocket of the article of apparel worn by the tennis player.

The scoreboard 14 has a substantially rectangular configuration with rounded corners which is similar to the configuration of each of the portable body 12 and the recess 18 of the body 12. As an example, the scoreboard 14 has a length which is greater than a width thereof which, in turn, is greater than a thickness thereof. Each of the width and the thickness of the scoreboard 14 is substantially uniform along the length thereof. The length, the width and the thickness of the scoreboard 14 are slightly less than the corresponding length, the width and the depth of the recess 18 of the body 12 such that the scoreboard 14 may fit snugly within the recess 18 of the portable body 12 and lie substantially flush with portions of the front side 12A of the portable body 12 which surround the recess 18 of the body 12. The scoreboard 14 has opposite front and back sides 14A, 14B and a continuous peripheral edge 14C. The peripheral edge 14C interconnects the front and back sides 14A, 14B. The front side 14A of the scoreboard 14 lies substantially flush with the portions of the front side 12A of the portable body 12 which surround the recess 18 thereof. The back side 14B and the peripheral edge 14C of the scoreboard 14 lie within the recess 18 of the portable body 12.

The scoreboard 14 has a middle region 20 and a pair of opposite side regions 22, though the elements of the middle region 20 (described below) may alone comprise the scoreboard 14. The side regions 22 are disposed on opposite sides of the middle region 20. As an example, each of the middle region 20 and the side regions 22 is comprised of a substantially rigid material, such as plastic, which is substantially the same as the material comprising the portable body 12. The middle region 20 has a substantially rectangular configuration. Each side region 22 has a substantially rectangular configuration with corners thereof spaced from the middle region being rounded. The side regions 22 are identical to one another. The middle region 20 preferably has an area which is greater than an area of one of the side regions 22, but the side regions 22 combined have an area greater than the area of the middle region 20.

The middle region 20 of the scoreboard 14 includes a first portion 24, a pair of tracks 26, second and third portions 28, 30 and a pair of markers 32. Each of the first, second and third portions 24, 28, 30 and the tracks 26 are disposed in a substantially diagonal orientation on the front side 14A of the scoreboard 14 and across the front side 12A of the body 12. The first portion 24 has opposite ends 24A and defines, as an example, a length extending between the ends 24A thereof which is greater than a width thereof. The width of the first portion 24 is substantially uniform along the length thereof but for the ends 24A of the first portion 24 being substantially pointed. The first portion 24 has a plurality of numbers and letters associated with points scored in a game of a tennis match. The numbers and letters of the first portion 24 are "Lv, 15, 30, 40 and A," which represent the points scored in a game. The first portion 24 also has a pair of borders 24B. Each border 24B extends substantially the length of the first portion 24 and is spaced from the other border 24B a distance substantially the same as the width of the first portion 24. The numbers and letters of the first portion 24 are disposed between and spaced from each of the borders 24B. The border 24B which is disposed below the numbers and letters of the first portion 24 has hash marks 24C extending in substantially perpendicular relation to and from the border 24B directly beneath and toward but spaced from the numbers and letters of the first portion 24. The first portion 24 also has dots 24D disposed between and spaced from the numbers and letters of the first line 24.

The tracks 26 of the middle region 20 are disposed on opposite sides of and in substantially parallel relation to the first portion 24. The tracks 26 are identical to one another. Each track 26 has opposite ends 26A and defines a length extending between the ends 26A thereof which is greater than a width thereof but less than the length of the first portion 24. The width of each track 26 is substantially the same as the width of the first portion 24 and is substantially uniform along the length thereof but for the ends 26A of each track 26 being angled. Each track 26 has a pair of borders 26B. Each border 26B extends substantially the length of the track 26 and is spaced from the other border 26B a distance substantially the same as the width of the track 26. The border 26B which is disposed adjacent to the first portion 24 is spaced from the border 24B of the first portion 24 adjacent thereto a distance less than the width of either of the first portion 24 or the track 26. Each track 26 is comprised of a first fastening means 34. As an example, the first fastening means 34 is one of a pair of hook or loop fastening elements which are complementary to and mateable with one another, though it need not be so limited.

Each of the second and third portion 28, 30 of the middle region 20 is disposed on a side of one of the tracks 26 opposite from the first portion 24 and disposed in substantially parallel relation to the one track 26. The second and third portions 28, 30 are identical to one another. Each of the second and third portions 28, 30 has opposite ends 28A, 30A and defines, as an example, a length extending between the ends 28A, 30A thereof which is greater than a width thereof but less than the length of each track 26. The width of each of the second and third portions 28, 30 is less than the width of each track 26 and is substantially uniform along the length thereof but for the ends 28A, 30A of the second and third portions 28, 30 being angled. Each of the second and third portions 28, 30 has a plurality of numbers associated with points scored in a tiebreaker of the tennis match. The numbers of each of the second and third portions 28, 30 are "0, 1, 2, 3, 4, 5, 6 and 7," which represent the points scored in a tiebreaker. The numbers of each of the second and third portions 28, 30 are smaller in size than the numbers and letters of the first portion 24. Each of the second and third portions 28, 30 also has a pair of borders 28B, 30B. Each border 28B, 30B extends substantially the length of one of the second and third portions 28, 30 and is spaced from the other border 28B, 30B a distance substantially the same as the width of the second or third portion 28, 30. The borders 28B, 30B which are disposed adjacent to the tracks 26 are spaced from the borders 26B of the tracks 26 adjacent thereto a distance less than the width of either of the second and third portions 28, 30. The numbers of the second and third portions 28, 30 are disposed between and spaced from the borders 28B, 30B. Each of the second and third portions 28, 30 also has dots 28C, 30C disposed between and spaced from the numbers of the second and third portions 28, 30. The numbers and letters, borders 24B, hash marks 24C and dots 24D of the first portion 24, the borders 26B of the tracks 26 and the numbers, borders 28B, 30B and dots 28C, 30C of the second and third portions 28, 30 are applied on the front side 14A of the scoreboard 14 by any suitable means, such as by being stamped, inscribed, printed, painted or embroidered.

Each marker 32 of the middle region 20 is mounted to and for undergoing movement along one of the tracks 26. Each marker 32 has a substantially rectangular configuration, though it need not be so limited. The markers 32 are identical to one another. As an example, each marker 32 has a length which is greater than a width thereof which, in turn, is greater than a thickness thereof. The length of each marker 32 is substantially the same as the width of each track 26. One marker 32 is alignable with the numbers and letters of the first portion 24 and the numbers of the second portion 28. The other marker 32 is alignable with the numbers and letters of the first portion 24 and the numbers of the third portion 30. The markers 32 are for indicating the points scored in a game and in a tiebreaker of the tennis match by players in a singles tennis match or by teams in a doubles tennis match. Each marker 32 has a bottom surface 32A comprised of a second fastening means 36 complementary to and removably mateable with the first fastening means 34 of one of the tracks 26 such that one marker 32 may be fastened to one track 26 in alignment with and be movable along and between the numbers and letters of the first portion 24 and the numbers of the second portion 28 and such that the other marker 32 may be fastened to the other track 26 in alignment with and be movable along and between the numbers and letters of the first portion 24 and the numbers of the third portion 30. As an example, the second fastening means 36 is the other of the hook and loop fastening elements which are complementary to and mateable with one another, though it need not be so limited.

The middle region 20 also includes a pair of spaces 38. Each space 38 is disposed on a side of one of the second and third portions 28, 30 opposite from one of the tracks 26. Each space 38 has a substantially triangular configuration. The spaces 38 are identical to one another. Each space 38 has an area which is less than a combined area of the first, second and third portions 24, 28, 30 and the tracks 26.

Each side region 22 of the scoreboard 14 includes a grid 40 and a plurality of markers 42. The grid 40 comprises most of the side portion 22. The grid 40 has a side axis 44, an end axis 46 extending in a generally orthogonal relationship to the side axis 44, a plurality of boxes 48 extending in rows and columns generally orthogonally aligned with one another adjacent to the side and end axes 44, 46, a plurality of boxes 50 along the side axis 44 and a pair of boxes 52 along the end axis 46. Each of the boxes 48, 50 and 52 is delineated and has a substantially rectangular configuration. The boxes 48, 50 are substantially identical to one another. Each of the boxes 48, 50, as an example, has a length and a width which are substantially the same. The boxes 52 are substantially identical and provided as inner and outer boxes 52A, 52B adjacent to one another.

The grid 40 of each side region 22 has a plurality of numbers associated with games won in one or more sets of the tennis match disposed numerically along the side axis 44. Each number along the side axis 44 is disposed within a box 50. The numbers along the side axis 44 are "0, 1, 2, 3, 4, 5, 6 and 7," which represent the games won in one or more sets. The grid 40 of each side region 22 also has a plurality of numbers associated with sets of the tennis match disposed numerically along the end axis 46. The numbers along the end axis 46 are disposed within the inner box 52A and are not separated into separate boxes. The numbers along the end axis 46 are "1, 2, 3, 4 and 5," which represent the sets. The numbers along each of the side axis 44 and the end axis 46 have substantially the same size as one another and as the numbers of the second and third portions 28, 30 of the middle region 20. The grid 40 of each side region 22 also has the word, "SET," which is disposed beyond the numbers along the end axis 46 and within the outer box 52B. The boxes 48, 50 and 52, the numbers along each of the side axis 44 and the end axis 46 and the word, "SET," are applied on the front side 14A of the scoreboard 14 by any suitable means, such as by being stamped, inscribed, printed, painted or embroidered.

Each marker 42 of each side region 22 is mounted to and for undergoing movement along the grid 40. Each marker 42 has a substantially rectangular configuration, though it need not be so limited. The markers 42 are identical to one another. Each marker 42 has, for example, a length and width which are substantially the same and which are each greater than a thickness thereof. The length and width of each marker 42 are substantially the same as the length and width of each box 48 of the grid 40. Each marker 42 is movable in generally orthogonal directions and positionable on one of the boxes 48 and is alignable with the numbers along the side axis 44 of the grid 40 for indicating the games won in a set of the tennis match by players in a singles tennis match or by teams in a doubles tennis match and is alignable with the numbers along the end axis 46 of the grid 40 for indicating the set of the tennis match. Each set should have its own marker 42 and the markers 42 should number three or five on each grid 40 for best of two out of three or for best of three out of five matches.

The boxes 48 of the grid 40 of each side region 22 are comprised of a first fastening means 54. As an example, the first fastening means 54 is one of a pair of hook and loop fastening elements which are complementary to and mateable with one another, though it need not be so limited. Each marker 42 of each side region 22 has a bottom surface 42A comprised of a second fastening means 56 complementary to and removably mateable with the first fastening means 54 of the boxes 48 of the grid 40 and such that each marker 42 may be fastened to the boxes 48 of the grid 40 in alignment with and be movable along the numbers along the side axis 44 of the grid 40 for indicating the games won in a set of the tennis match by players in a singles tennis match or by teams in a doubles tennis match and in alignment with and be movable along the numbers along the end axis 46 of the grid 40 for indicating the set of the tennis match. As an example, the second fastening means 56 is the other of the hook and loop fastening elements which are complementary to and mateable with one another, though it need not be so limited.

The scoreboard 14 also has a continuous border 58 on the front side 14A thereof extending around a periphery of the middle region 20 and the side regions 22 thereof. The border 58 has a configuration which generally conforms to the configuration of the scoreboard 14. The border 58 covers space having an area which is substantially less than the combined area of the middle region 20 and the side regions 22.

The securing means 16 includes an elongated strap 60. The strap 60 is comprised of a substantially flexible material, such as nylon. The strap 60 has opposite side surfaces 60A, 60B, opposite first and second ends 60C, 60D and a pair of first and second patches 62, 64. As an example, the strap 60 has a length extending between the first and second ends 60C, 60D which is greater than a width thereof extending substantially perpendicular to the length. The strap 60 at the first end 60C thereof is mounted to the body 12 by any suitable means and such that the side surface 60A of the strap 60 is against the back side 12B of the body 12. The second end 60D of the strap 60 is free. Each of the first and second patches 62, 64 has a substantially rectangular configuration. Each of the first and second patches 62, 64 has an area which is substantially the same as the area of the other and which is substantially less than an area of the strap 60. As an example, each of the first and second patches 62, 64 is substantially square in configuration. The width of each of the first and second patches 62, 64 is substantially the same as the width of the strap 60. The first patch 62 is mounted to the side surface 60A spaced from but adjacent to the first end 60C of the strap 60. The first patch 62 is comprised of a first fastening means 66. As an example, the first fastening means 66 is one of a pair of hook and loop fastening elements which are complementary to and mateable with one another, though it need not be so limited. The second patch 64 is mounted to the side surface 60A adjacent to the second end 60D of the strap 60. The second patch 64 is comprised of a second fastening means 68 complementary to and removably mateable with the first fastening means 66 of the first patch 62 and such that the strap 60 may be wrapped around a portion of the article of clothing worn by the tennis player and the second patch 64 may be fastened to the first patch 62 so as to form a closed loop for retaining the strap 60 on the portion of the article of clothing worn by the tennis player. As an example, the second fastening means 68 is the other of the hook and loop fastening elements which are complementary to and mateable with one another, though it need not be so limited.

Figure 3:
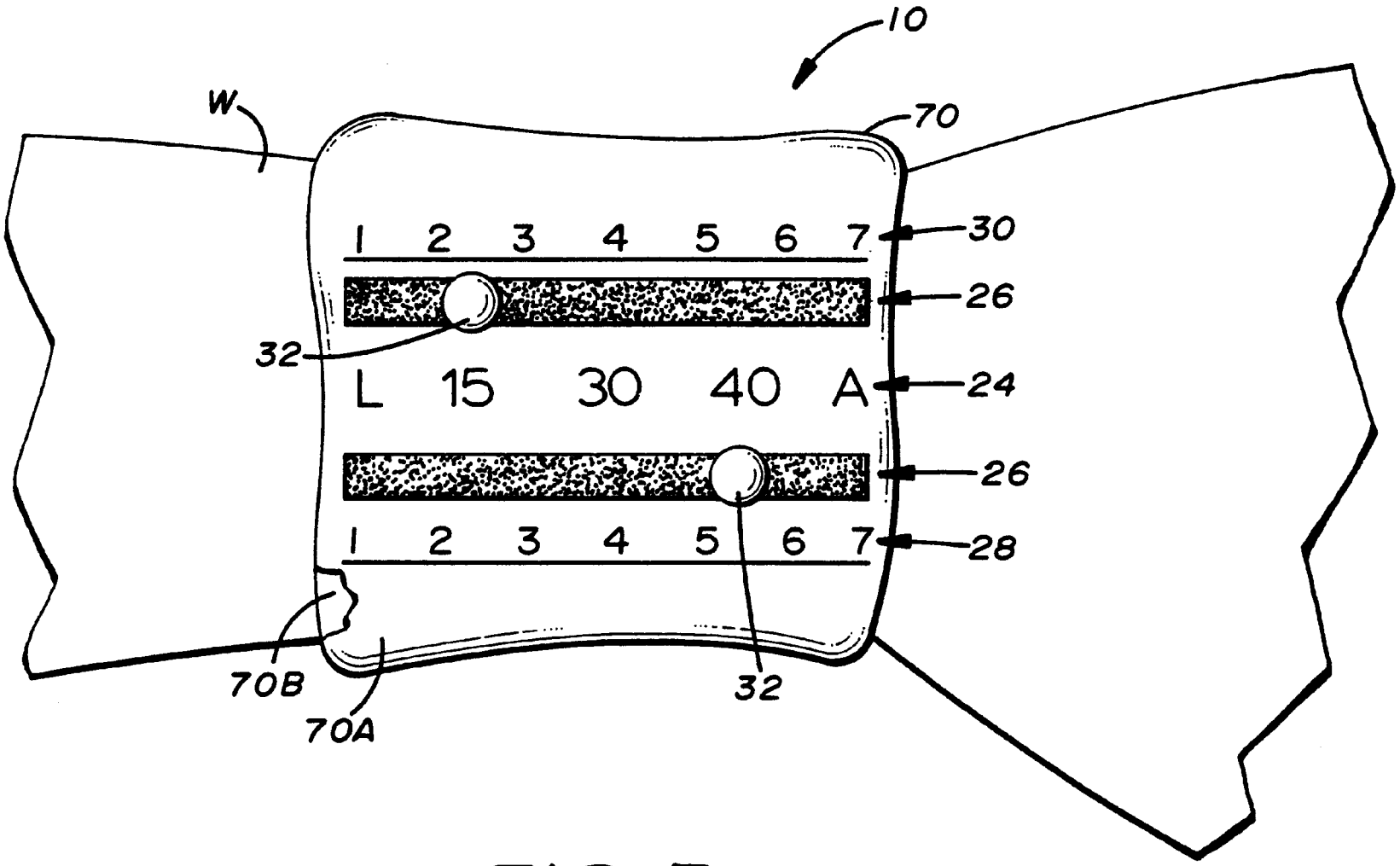
FIG. 3 is a top plan view of a second embodiment of the portable tennis scorekeeper device of the present invention.

Referring now to FIG. 3, there is illustrated a second embodiment of the portable tennis scorekeeper device 10 of the present invention. In the second embodiment, the portable body 12 of the device 10 is in the form of a band 70 and the scoreboard 14 is applied on the band 70. The band 70 is adapted to be worn around a wrist W of a tennis player. The band 70 is comprised of a substantially resilient material, such as stretch terrycloth, leather or any other suitable material. The band 70 preferably is stretchible and is provided in an annular configuration. The band 70 may be of any suitable size. As an example, the band 70 has an annular length which is greater than a transverse width thereof which, in turn, is greater than a thickness thereof. The band 70 has opposite outer and inner sides 70A, 70B. The scoreboard 14 is applied on the outer side 70A of the band 70. The inner side 70B of the band 70 faces inwardly and contacts the wrist W of the tennis player when the band 70 is disposed around the wrist W of the tennis player. The scoreboard 14 of the second embodiment has substantially the same first, second and third portions 24, 28 and 30, pair of tracks 26 and pair of markers 32 as provided in the first embodiment. One difference between the first and second embodiments, besides the form of the portable body 12, is that the first, second and third portions 24, 28, 30, tracks 26 and markers 32 of the scoreboard 14 of the second embodiment are not slanted on the band 70. Another difference between the first and second embodiments is that the scoreboard 14 of the second embodiment does not have the side regions 22 as provided in the first embodiment.

It should be understood that, instead of providing complementary hook and loop fastening elements on the tracks 26 and markers 42, other suitable arrangements could be used which will be apparent to one of ordinary skill in the art. For instance, the tracks 26 could be elongated threads, cords, wires and the like fixedly attached at its opposite ends to the portable body 12 and the markers 42 could be beads, rings and the like snugly fitted over the threads, cords or wires and slidably movable thereon between their opposite ends.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A portable tennis scorekeeper device, comprising:

(a) a portable body supportable on a tennis player and having a side; and (b) a scoreboard applied to said side of said portable body and including (i) a first portion having a plurality of numbers and letters associated with points scored in a game of a tennis match, (ii) a pair of tracks disposed on opposite sides of and in substantially parallel relation to said first portion, (iii) second and third portions each disposed on a side of one of said tracks opposite from said first portion and disposed in substantially parallel relation to said one track and having a plurality of numbers associated with points scored in a tiebreaker of the tennis match, each of said first, second and third portions and said tracks of said scoreboard being disposed in a substantially diagonal orientation across said side of said portable body, and (iv) a pair of markers each capable of mounting to and being moved along a respective one of said tracks and being alignable with said numbers and letters of said first portion and said numbers of a corresponding one of said second and third portions such that said markers indicate the points scored in a game and in a tiebreaker of the tennis match by players in a singles tennis match or by teams in a doubles tennis match.

2. A portable tennis scorekeeper device, comprising:

(a) a portable body supportable on a tennis player and having a side; and (b) a scoreboard applied to said side of said portable body and including (i) a first portion having a plurality of numbers and letters associated with points scored in a game of a tennis match, (ii) a pair of tracks disposed on opposite sides of and in substantially parallel relation to said first portion, each of said tracks of said scoreboard being comprised of a first fastening means, (iii) second and third portions each disposed on a side of one of said tracks opposite from said first portion and disposed in substantially parallel relation to said one track and having a plurality of numbers associated with points scored in a tiebreaker of the tennis match, and (iv) a pair of markers each capable of mounting to and being moved along a respective one of said tracks and being alignable with said numbers and letters of said first portion and said numbers of a corresponding one of said second and third portions such that said markers indicate the points scored in a game and in a tiebreaker of the tennis match by players in a singles tennis match or by teams in a doubles tennis match, each of said markers of said scoreboard having a bottom surface comprised of a second fastening means complementary to and removably mateable with said first fastening means of a respective one of said tracks of said scoreboard such that said each of said markers may be detachably fastened to said respective one of said tracks in alignment with and be movable along and between said numbers and letters of said first portion and said corresponding one of said second and third portions of said scoreboard.

3. A portable tennis scorekeeper device, comprising:

(a) a portable body supportable on a tennis player and having a side, said portable body also having a recess defined in said side thereof; and (b) a scoreboard applied to said side of said portable body, said scoreboard fitting within said recess of said portable body and lying substantially flush with portions of said side of said portable body surrounding said recess, said scoreboard including (i) a first portion having a Plurality of numbers and letters associated with points scored in a game of a tennis match, (ii) a pair of tracks disposed on opposite sides of and in substantially parallel relation to said first portion, (iii) second and third portions each disposed on a side of one of said tracks opposite from said first portion and disposed in substantially parallel relation to said one track and having a plurality of numbers associated with points scored in a tiebreaker of the tennis match, and (iv) a pair of markers each capable of mounting to and being moved along a respective one of said tracks and being alienable with said numbers and letters of said first portion and said numbers of a corresponding one of said second and third portions such that said markers indicate the points scored in a game and in a tiebreaker of the tennis match by players in a singles tennis match or by teams in a doubles tennis match.

4. A portable tennis scorekeeper device, comprising:

(a) a portable body supportable on a tennis player and having a side, said portable body being an article of apparel worn by the tennis player; and (b) a scoreboard applied to said side of said portable body and including (i) a first portion having a plurality of numbers and letters associated with points scored in a game of a tennis match, (ii) a pair of tracks disposed on opposite sides of and in substantially parallel relation to said first portion, (iii) second and third portions each disposed on a side of one of said tracks opposite from said first portion and disposed in substantially parallel relation to said one track and having a plurality of numbers associated with points scored in a tiebreaker of the tennis match, and (iv) a pair of markers each capable of mounting to and being moved along a respective one of said tracks and being alignable with said numbers and letters of said first portion and said numbers of a corresponding one of said second and third portions such that said markers indicate the points scored in a game and in a tiebreaker of the tennis match by players in a singles tennis match or by teams in a doubles tennis match.

5. A portable tennis scorekeeper device, comprising:

(a) a portable body supportable on a tennis Player and having a side;

(b) a scoreboard applied to said side of said portable body and including (i) a first portion having a plurality of numbers and letters associated with points scored in a game of a tennis match, (ii) a pair of tracks disposed on opposite sides of and in substantially parallel relation to said first portion, (iii) second and third portions each disposed on a side of one of said tracks opposite from said first portion and disposed in substantially parallel relation to said one track and having a plurality of numbers associated with points scored in a tiebreaker of the tennis match, and (iv) a pair of markers each capable of mounting to and being moved along a respective one of said tracks and being alignable with said numbers and letters of said first portion and said numbers of a corresponding one of said second and third portions such that said markers indicate the points scored in a game and in a tiebreaker of the tennis match by players in a singles tennis match or by teams in a doubles tennis match; and means for securing said portable body to an article of apparel worn by the tennis player.

6. The device of claim 5 wherein said securing means includes a strap having a side surface, opposite first and second ends and a pair of first and second attachment patches, said strap at said first end thereof mounted to said portable body, said first patch of said strap mounted to said side surface and spaced from but adjacent to said first end of said strap and being comprised of a first fastening means, said second patch of said strap being mounted to said side surface adjacent to said second end of said strap and being comprised of a second fastening means complementary to and removably mateable with said first fastening means of said first patch such that said strap may be wrapped around a portion of the article of apparel worn by the tennis player and said second patch may be fastened to said first patch so as to form a closed loop for retaining said strap on the portion of the article of apparel worn by the tennis player.

7. A portable tennis scorekeeper device, comprising:

(a) a portable body supportable on a tennis player and having a side; and (b) a scoreboard applied to said side of said portable body and having a middle region and a pair of opposite side regions disposed on opposite sides of said middle region;

(c) said middle region of said scoreboard including means for indicating the points scored in a game and in a tiebreaker of the tennis match by players in a singles tennis match or by teams in a doubles tennis match;

(d) each of said side regions of said scoreboard including (i) a grid having a side axis, an end axis extending in a generally orthogonal relationship to said side axis, a plurality of boxes arranged in rows and columns and aligned with one another adjacent to said side and end axes, a plurality of numbers associated with games won in one or more sets of the tennis match disposed numerically along one of said side and end axes and a plurality of numbers associated with sets of the tennis match disposed numerically along the other of said side and end axes, and (ii) a plurality of markers each capable of mounting to and being moved along said grid and in generally orthogonal directions and positionable on one of said boxes of said grid for alignment with said numbers along said one of said side and end axes of said grid for indicating the games won in a set of the tennis match by players in a singles tennis match or by teams in a doubles tennis match and for alignment with said numbers along said other of said side and end axes of said grid for indicating the set of the tennis match.

8. The device of claim 7 wherein said indicating means on said middle region of said scoreboard includes:

a first portion having a plurality of numbers and letters associated with points scored in a game of a tennis match;

a pair of tracks disposed on opposite sides of and in substantially parallel relation to said first portion;

second and third portions each disposed on a side of one of said tracks opposite from said first portion and disposed in substantially parallel relation to said one track and having a plurality of numbers associated with points scored in a tiebreaker of the tennis match; and a pair of markers each capable of mounting to and being moved along a respective one of said tracks and being alignable with said numbers and letters of said first portion and said numbers of a corresponding one of said second and third portions such that said markers indicate the points scored in a game and in a tiebreaker of the tennis match by players in a singles tennis match or by teams in a doubles tennis match.

9. The device of claim 8 wherein each of said first, second and third portions and said tracks of said middle region of said scoreboard are disposed in a substantially diagonal orientation across said side of said portable body.

10. The device of claim 8 wherein:

each of said tracks of said middle region of said scoreboard is comprised of a first fastening means; and each of said markers of said middle region of said scoreboard has a bottom surface comprised of a second fastening means complementary to and removably mateable with said first fastening means of a respective one of said tracks of said middle region of said scoreboard such that said each of said markers may be detachably fastened to said respective one of said tracks in alignment with and be movable along and between said numbers and letters of said first portion and said corresponding one of said second and third portions of said scoreboard.

11. The device of claim 7 wherein:

said boxes of said grid of each of said side regions of said scoreboard are comprised of a first fastening means; and each of said markers of each of said side regions of said scoreboard has a bottom surface comprised of a second fastening means complementary to and removably mateable with said first fastening means such that each of said markers may be fastened to said boxes of said grid in alignment with and be movable along said numbers along said one of said side and end axes of said grid for indicating the games won in a set of the tennis match by players in a singles tennis match or by teams in a doubles tennis match and in alignment with and be movable along said numbers along said other of said side and end axes of said grid for indicating the set of the tennis match.

12. The device of claim 7 wherein:

said portable body has a recess defined in said side thereof; and said scoreboard fits within said recess of said portable body and lies substantially flush with portions of said side of said portable body surrounding said recess.

13. The device of claim 7 wherein said portable body is an article of apparel worn by the tennis player.

14. The device of claim 7 further comprising:

means for securing said portable body to an article of apparel worn by the tennis player.

15. The device of claim 14 wherein said securing means includes a strap having a side surface, opposite first and second ends and a pair of first and second attachment patches, said strap at said first end thereof mounted to said portable body, said first patch of said strap mounted to said side surface and spaced from but adjacent to said first end of said strap and being comprised of a first fastening means, said second patch of said strap being mounted to said side surface adjacent to said second end of said strap and being comprised of a second fastening means complementary to and removably mateable with said first fastening means of said first patch such that said strap may be wrapped around a portion of the article of apparel worn by the tennis player and said second patch may be fastened to said first patch so as to form a closed loop for retaining said strap on the portion of the article of apparel worn by the tennis player.

16. A pocket tennis scorekeeper device, comprising:

(a) a band adapted to be worn around a wrist of a tennis player and having a side; and (b) a scoreboard formed on said side of said band and including (i) a first portion having a plurality of numbers and letters associated with points scored in a game of a tennis match, (ii) a pair of tracks disposed on opposite sides of and in substantially parallel relation to said first line, (iii) second and third portions each disposed on a side of one of said tracks opposite from said first portion and disposed in substantially parallel relation to said one track and having a plurality of numbers associated with points scored in a tiebreaker of the tennis match, and (iv) a pair of markers each capable of mounting to and being moved along a respective one of said tracks and being alignable with said numbers and letters of said first portion and said numbers of a corresponding one of said second and third portions such that said markers indicate the points scored in a game and in a tiebreaker of the tennis match by players in a singles tennis match or by teams in a doubles tennis match.

17. The device of claim 16 wherein said band is comprised of a substantially stretchable and resilient material.

18. The device of claim 16 wherein:

each of said tracks of said scoreboard is comprised of a first fastening means; and each of said markers of said scoreboard has a bottom surface comprised of a second fastening means complementary to and removably mateable with said first fastening means of a respective one of said tracks of said scoreboard such that said each of said markers may be detachably fastened to said respective one of said tracks in alignment with and be movable along and between said numbers and letters of said first portion and said corresponding one of said second and third portions of said scoreboard.

19. The device of claim 16 wherein each of said markers of said scoreboard has a substantially round configuration.

* * * * *